United States Patent [19]

Ahlström

[11] Patent Number: 4,796,834

[45] Date of Patent: Jan. 10, 1989

[54] METHOD FOR COMBATTING OF TARGETS AND PROJECTILE OR MISSILE FOR CARRYING OUT THE METHOD

[75] Inventor: Lars G. W. Ahlström, Stockholm, Sweden

[73] Assignee: U.S. Philips Corporation, New York, N.Y.

[21] Appl. No.: 599,215

[22] Filed: Apr. 12, 1984

Related U.S. Application Data

[63] Continuation of Ser. No. 298,129, Aug. 31, 1981, abandoned.

[30] Foreign Application Priority Data

Sep. 15, 1980 [SE] Sweden ..... 8006457

[51] Int. Cl.[4] ..... F41G 7/22

[52] U.S. Cl. ..... 244/3.16; 89/1.11; 244/3.1

[58] Field of Search ..... 244/3.1, 3.13, 3.15, 244/3.16, 3.19; 89/1 A; 102/374, 384

[56] References Cited

U.S. PATENT DOCUMENTS 2,987,269 6/1961 Weller ..... 244/3.13
3,124,072 3/1964 Herrmann ..... 102/374
3,835,749 9/1974 Joneaux ..... 244/3.16
4,004,487 1/1977 Eichweber ..... 244/3.15
4,457,475 7/1984 Ahlström ..... 244/3.15

FOREIGN PATENT DOCUMENTS 1419471 12/1975 United Kingdom .

*Primary Examiner*—Charles T. Jordan
*Attorney, Agent, or Firm*—Thomas A. Briody; Leroy Eason

[57] ABSTRACT

Projectiles fired toward a target are provided with target tracking devices for automatic guidance. To improve accuracy of fire at least one projectile in a burst is provided with an illumination source which is activated by a target detector at the end of the projectile trajectory. The source selectively illuminates the target and its closest surroundings with radiation for which the target tracking device in other projectiles is sensitive. A following projectile corrects its trajectory toward the target. All projectiles in a burst can be provided with an illumination source which is activated at the end of the trajectory as a guidance aid for following projectiles.

2 Claims, 5 Drawing Sheets

METHOD FOR COMBATTING OF TARGETS AND PROJECTILE OR MISSILE FOR CARRYING OUT THE METHOD

This is a continuation of application Ser. No. 298,129, filed Aug. 31, 1981, abandoned.

BACKGROUND OF THE INVENTION

The invention relates to a method for guiding toward a target explosive projectiles provided with target tracking devices. Each target tracking device receives and detects electromagnetic radiation and produces an error signal indicating a deviation between the trajectory of the respective projectile and a trajectory passing through the target. The error signal controls guidance means on the projectile for reducing the deviation to zero.

In order to improve the accuracy of projectiles comprising such tracking devices, it has previously been proposed to illuminate the target area with electromagnetic radiation, to which the tracking device is sensitive. It is difficult, however to achieve sufficient illumination at reasonable costs and reliability. If the illuminator is placed at a large distance from the target, in order to be protected, a very high power illumination source is required. If the illuminator is placed in a unit close to the target (for example in an airplane flying across the target) it will be exposed to hostile fire.

In order to solve these problems it has previously been proposed to fire a burst of projectiles including a special projectile having an illumination source for illuminating the target area. This projectile serves only to illuminate a zone where a target may be present, as an aid for other projectiles so that the target tracking devices in these projectiles can more easily discover the target. Such an illumination projectile does not deliver any target information, because it illuminates a given zone whether or not there is any target within the zone.

SUMMARY OF THE INVENTION

An object of the invention is to provide a simple, inexpensive, and effective solution to the above problem. In accordacne with the invention, a plurality of projectiles fired at a target includes at least one projectile having illumination means which is activated in response to detection of a target. The illumination means produces selective illumination of the target area with radiation to which the target tracking device in another fired projectile is sensitive. The device produces a trajectory correction in the respective projectile in response to the selective illumination of the target area by the first projectile.

Preferably the illumination means is activated at the end of the trajectory of the illuminating projectile. All projectiles fired in a burst can be identical and include illumination means which are activated at the end of the trajactories of the respective projectiles.

In a method according to the invention, a target area is illuminated at least during the last part of the trajectory of the illuminating projectile, but only after the detector in the projectile has detected the presence of a target in its scanning area. The target detector also determines the position of the target and causes the illumination means to produce a concentrated illumination of just that area where the target is situated thereby increasing the effectiveness of the illumination. In a following receiving projectile detection of an illuminated spot is used as an indication of the presence of a target. Correction of the receiving projectile trajectory can be effected such that the projectile is guide to the illuminated spot. The target tracking device in the receiving projectile thus does not need to discover the target itself during this correction phase, but utilizes the detector in the foregoing projectile for its correction. When the illuminating projectile has hit the ground or the target, the receiving projectile will continue in its corrected trajectory and tries in this phase to detect the target on its own. When the target's own radiation is detected, it is used for final guidance.

As mentioned, all projectiles can suitably be provided with illumination means which are each activated at the end of the respective projectile is trajectory for giving target information to a following projectile. In a burst of such projectiles, each projectile will have a more accurate trajectory toward the target than the closest foregoing projectile, and a reliable hit will be achieved after a relatively small number of projectiles complete their trajectories.

One form of a projectile for carrying out the method according to the invention comprises an illumination source with means for directing the illumination against a selected area. The illumination source cooperates with a detector device adapted to detect the presence of a target within a scanning area. After detection of a target the illumination source selectively illuminates a limited area containing the target. The illumination source produces radiation to which the target tracking device in another projectile is sensitive, effecting trajectory correction in this other projectile toward the illuminated spot.

In one embodiment, a projectile according to the invention has both a target tracking device and an illumination source. The detector device for activating the illumination source is preferably the same detector as that included in the target tracking device. Then one attenna or lens element can be used both for directing the illumination against the target and tracking the target. The directing means for directing the illumination against the target can be formed by means for locking the activation circuit of an antenna in a given position for selecting that antenna lobe, in which the target is situated, or means for adjusting and locking a scanning mirror in a given position.

The guidance of a projectile according to the invention is effected in two substantially different modes. These are a semi-active mode or illumination mode, when the target is illuminated by another illumination source (another projectile), and an independent target finding mode when the target tracking device in a projectile operates independently by detecting the target's own radiation or radiation transmitted from the projectile and reflected by the target. Preferably switching means are arranged for setting the target tracking device comprising a receiver, a detector arrangement, and a signal processing unit in either of two conditions, one for the semi-active mode and one for the independent target finding mode.

If desired a modulator can be included for modulating the illumination. The receiver channel for receiving and detecting radiation transmitted from another projectile would then include a demulator.

BRIEF DESCRIPTION OF THE DRAWING

The invention is illustrated in the accompanying drawing, in which

In the drawing FIGS. 1*a*, 2*a* and 3*a* each show the condition in the respective projectile's target tracking device when the projectile is situated at a large distance from a target, for example 2 to 3 kilometers, when the target has been detected and illuminated by a foregoing projectile. FIGS. 1*b*, 2*b* and 3*b* each illustrate the condition in the respective target tracking device when the illumination of the target has ceased and the target tracking device has to operate on its own without auxiliary illumination. FIGS. 1*c*, 2*c* and 3*c* each show the condition in the respective target tracking device when the respective projectile is situated very close to the target and illuminates the target for guiding a following projectile. For the sake of simplicity, corresponding components have been given the same reference numerals in the different embodiments, even if they are configured somewhat differently because of the different types of radiation used. All target tracking devices are of a conventional construction and are therefore shown only schematically.

All projectiles in the different embodiments are assumed to be mutually identical and provided with both a target tracking device and an illumination source and means for activating the illumination source at the end of the trajectory. The projectiles are fired at such short intervals that, when a projectile is illuminating the target the closest following projectile is situated at a suitable distance for detecting the illuminated spot, for example from 2 to 3 kilometers from the target.

Figure 1A:
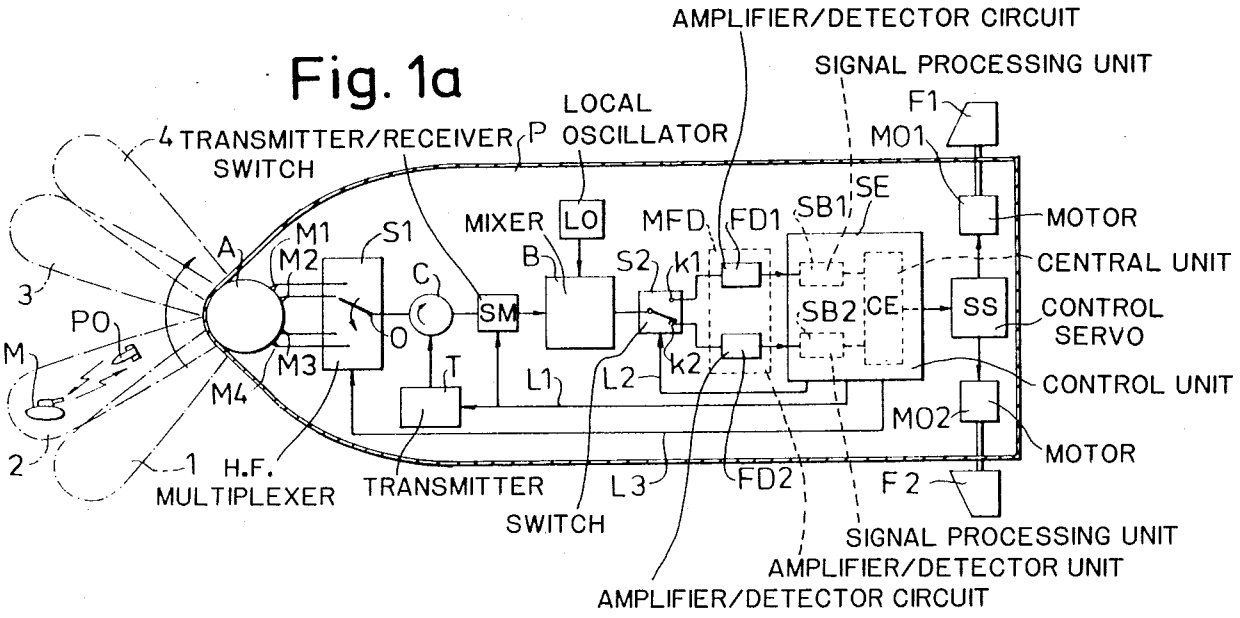
FIGS. 1*a*, 1*b* and 1*c* show a simplified block diagram for a projectile according to the invention provided with a radiometric target tracking device for operating in the millimeter range in different stages of the guidance towards a target.
Figure 1B:
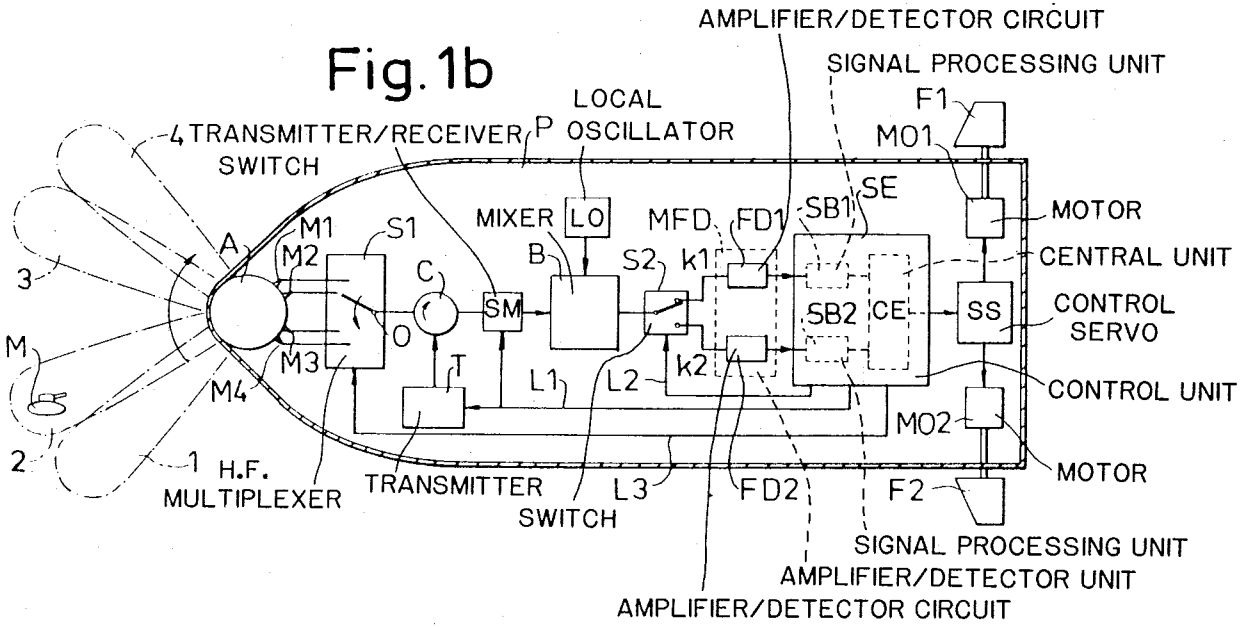
Figure 1C:
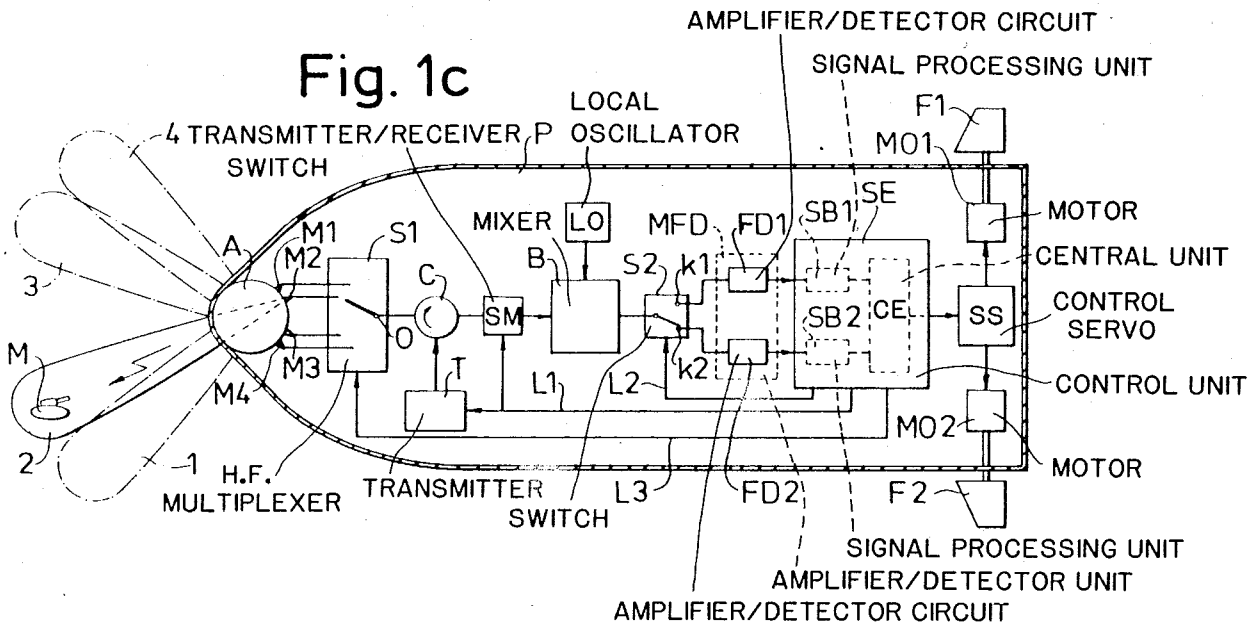

The projectile P shown in FIGS. 1*a*, 1*b*, 1*c* has in its nose an antenna A in the form of a Luneberg lens, which in the example has four feeders M1, M2, M3 and M4 corresponding to different sensitivity or transmission lobes designated 1, 2, 3 and 4, respectively. The feeders are each connected to a respective input of a HF multiplexer, such as a PIN switch S1. The common output O of the switch S1 is coupled by way of a circulator C and a transmitter/receiver switch SM to an input of a mixer B. In the mixer the energy from the antenna is combined with the energy from a local oscillator LO and the mixing product is an intermediate frequency which is coupled via a switch S2 and an amplifier and detector unit MFD to a control unit SE, which preferably comprises a microprocessor. The control unit delivers via a control servo SS control signals to two motors MO1 and MO2 each driving a respective guiding fin F1, F2.

The amplifier and detector unit MFD comprises a filter, amplifier and detector means for separating a target signal from received radiation. The target tracking device can according to the invention operate in two different modes, in which different requirements are placed upon the amplifier and detector unit. To illustrate this the unit MFD is in the drawing divided into two circuits FD1 and FD2 which can be alternatively made effective by control of the switch S2. The signal processing in SE can also be somewhat different in the different operation modes and to illustrate this signal processing is provided by two units, SB1 and SB2, one for the signal from FD1 and the other for the signal from FD2. The signals obtained by the signal processing in SB1 and SB2, respectively, are coupled to a central unit CE included in the unit SE, which central unit CE delivers its output signal to the servo for controlling the guiding fins.

According to the invention each projectile is further provided with an illumination source in the shape of a transmitter T having its output connected to an input of the circulator C. The transmitter T delivers a radiation, in the present example within the millimeter range, which the circuit FD2 in the amplifier and detector unit MFD in the receiving projectile is adapted to detect. The transmitter T is started by a command signal on a command line L1, which command signal comes from the control unit SE and is also used to control the transmitter/receiver switch SM. The control unit SE also controls via control lines L2, L3 the setting of the HF multiplexer S1 and the switch S2, thereby determining which one of the antenna lobes and which one of the amplifier/detectors and signal processing unit is active.

Operation is as follows, reference first being made to FIG. 1*a*.

In FIG. 1*a* the projectile is situated so far from a target that its own target tracking device is in its normal passive operating mode and cannot detect the radiation of the target, but the closest foregoing projectile in the burst, which is shown at PO, has discovered a target M and is illuminating the target with electromagnetic energy from its transmitter T. The target tracking device in projectile P has its switch S2 set in the position k2, so that the amplifier and detector circuit FD2 and the signal processing unit SB2 are active. This position effects reception of the illuminating radiation, while the signal processing unit SB2 via the multiplexed lobe scanning, aims at determination of the position of the illuminated spot from which radiation is received relative to the projectile's own trajectory. As a result of this position determination the unit CE generates an error signal, which via the servo SS and the motors MO1 and MO2 controls the guiding fins F1, F2 for reducing the error signal to zero. This consequently involves a correction of the trajectory in direction towards the illuminated spot. This mode continues as long as significant illuminating radiation is received.

When the foregoing projectile, which was illuminating the target, hits the ground the illumination disappears and this is sensed in the following projectile as an interruption of the target signal, because the projectile is often situated too far from the target to detect the target's own radiation. This causes the control unit SE to reset the switch S2 to the position k1, which is the normal listening position. Memory means, either in the central unit CE or in the guiding servo SS, ensure that the correction, which was made during the foregoing operation mode by setting the fins F1, F2, will remain and the projectile now continues in a corrected trajectory against the target.

In the listening mode the antenna is scanning, the transmitter T inactivated and the switch S2 as mentioned situated in the passive target tracking or listening position k1. Normally broad band radiometric reception is utilized, because the target's own radiation frequency is not exactly known and it is desirable to receive as much energy from the target as possible.

In the situation shown in FIG. 1*b* the target tracking device has discovered a signal from the target M in lobe 2. The switch S2 remains in the position k1 and the received signal is applied via FD1 to SB1 for signal processing. The purpose of this signal processing is as previously described to determine the position of the target relative to the projectile's own trajectory and to produce therefrom an error signal, which is applied to the guiding servo and driving motors for adjusting the guiding fins in such direction that the error signal approaches zero. If the target tracking device is able to regulate the error signal exactly to zero the projectile will hit the target.

Immediately before the projectile has reached the target, for example when it is situated 50 to 100 meters from the target, automatic switching to illumination mode, which is illustrated in FIG. 1*c*, takes place. In this mode the HF multiplexer S1 is locked in the position in which the common contact O is connected to the feeder corresponding to that antenna lobe, within which the target is situated, and the transmitter T is activated. The target area is thus illuminated selectively with a narrow, concentrated radiation beam and during this phase trajectory correction is effected in the following projectile.

As the target tracking device in this example is purely passive it produces no distance information and the switching to illumination mode is therefore timed. The switching can be effected so close to the target that further influence of the guiding means of the projectile is ineffective, for example 50 to 100 meters from the target. Alternatively the illumination mode according to FIG. 1*c* can take place intermittently and alternate with the passive listening mode according to FIG. 1*b* during a somewhat prolonged time period at the last part of the projectile trajectory against the target. Instead of time based switching to the illumination mode a separate distance detector can also be used for this switching.

Figure 2A:
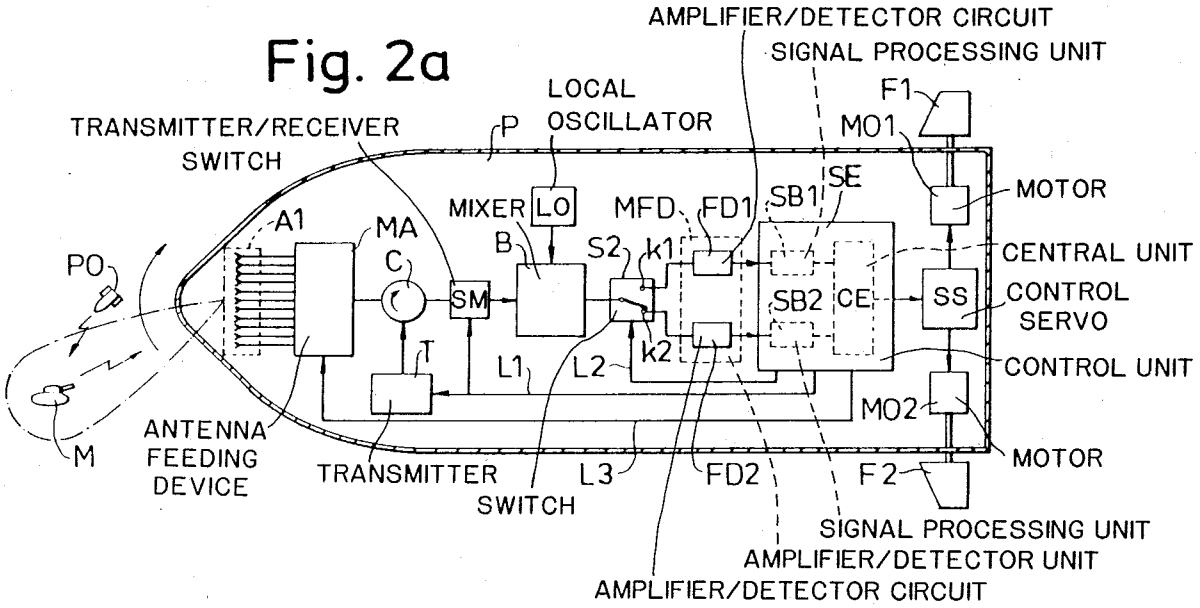
FIGS. 2*a*, 2*b* and 2*c* show the corresponding block diagram for a projectile comprising a target tracking device utilizing radar.
Figure 2B:
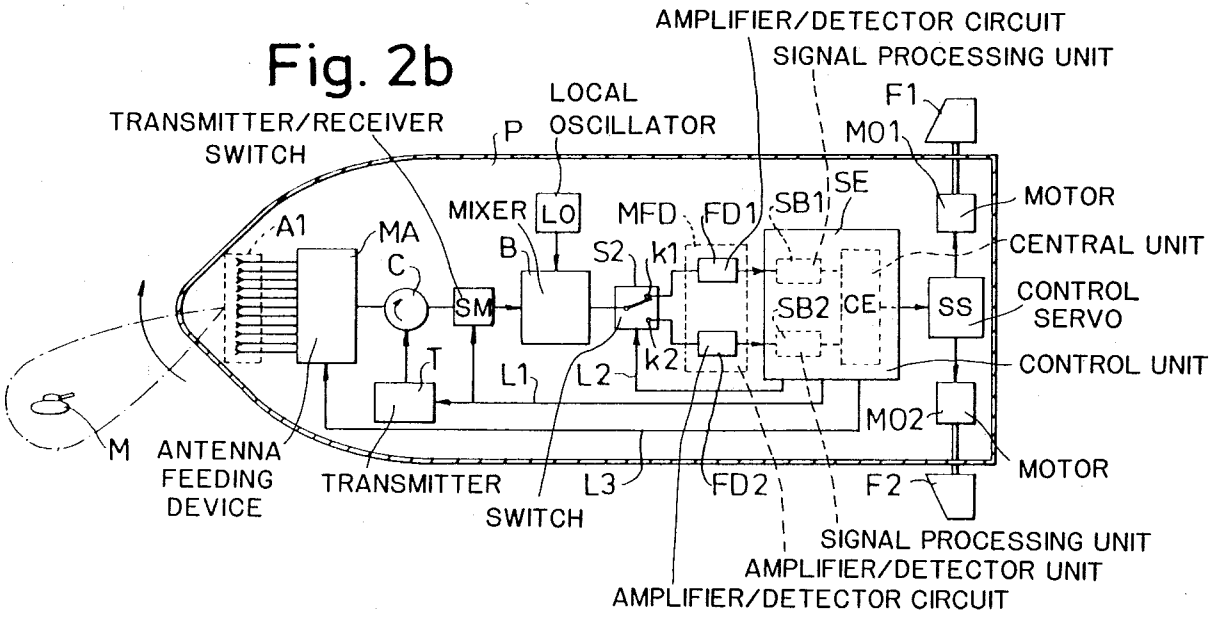
Figure 2C:
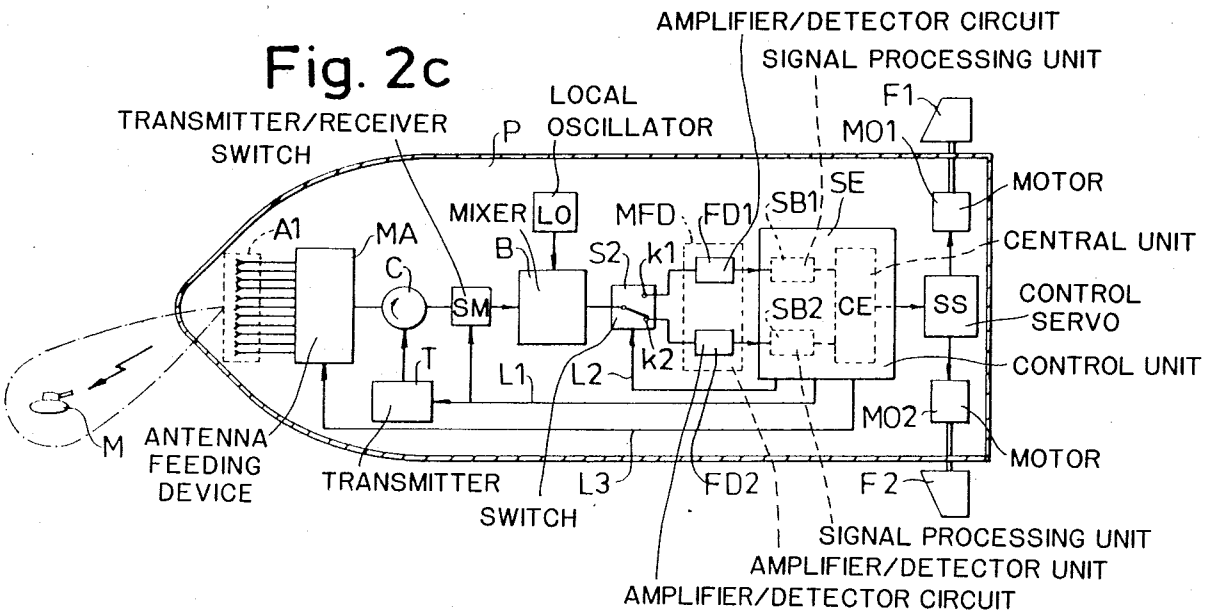

FIGS. 2*a*, 2*b* and 2*c* show the corresponding simplified block diagram for a projectile provided with a target tracking device utilizing radar. In this case the transmitter T is a radar transmitter for transmitting radar signals on command from the unit SE, while the receiver is a radar receiver having substantially the same construction as the receiver described in the foregoing. The antenna is in this example a so called phase controlled antenna Al comprising a number of antenna elements fed from a feeding device MA, which determines the mutual phase position between the activation of different antenna elements and thereby the lobe direction obtained. Also in this case there are two amplifier and detector units FD1 and FD2 followed by two signal processing units SB1 and SB2, which are made alternatively active by switch S2.

FIG. 2*a* illustrates the situation when a target M has been discovered by the foregoing projectile and is illuminated by the same. The target tracking device in the projectile P operates in the passive mode, meaning that it does not utilize its own transmitter but receives radiation from the area which is illuminated by the foregoing projectile. The switch S2 is in the semi-active mode position k2, causing the reception and the signal processing to be matched to the radiation transmitted from the foregoing projectile. If desired the receiver means in the projectile P can be synchronized with the transmitter in the foregoing projectile PO. The central unit CE utilizes the received and processes target signal to make a calculation of the deviation of the projectile trajectory from a trajectory through the target and effects correction of the trajectory.

In FIG. 2*b* the illuminating projectile has disappeared and the target tracking device now operates in its normal radar mode. After discovery of the target determination of the target position and guidance of the projectile is effected in usual manner.

In FIG. 2*c* the projectile is very close to the target and the feeding device MA is locked in a position with such mutual phase difference between the individual antenna elements that the generated lobe is directed towards the target. The transmitter T is activated so that the target is exposed to strong and concentrated illumination serving as an aid for the following projectile.

Figure 3A:
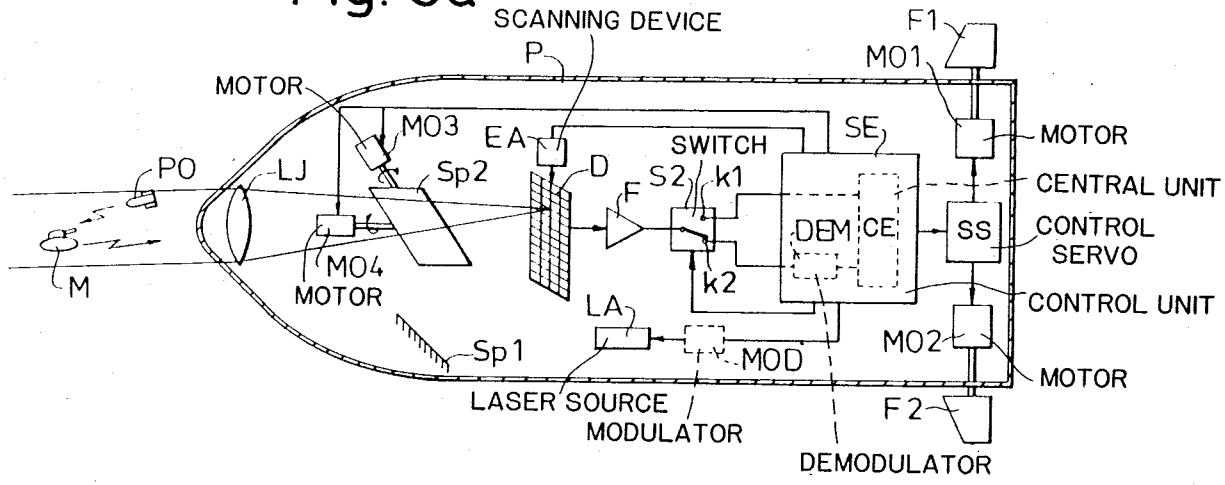
FIGS. 3*a*, 3*b* and 3*c* show the corresponding block diagram for a projectile comprising an electro-optic target tracking device.
Figure 3B:
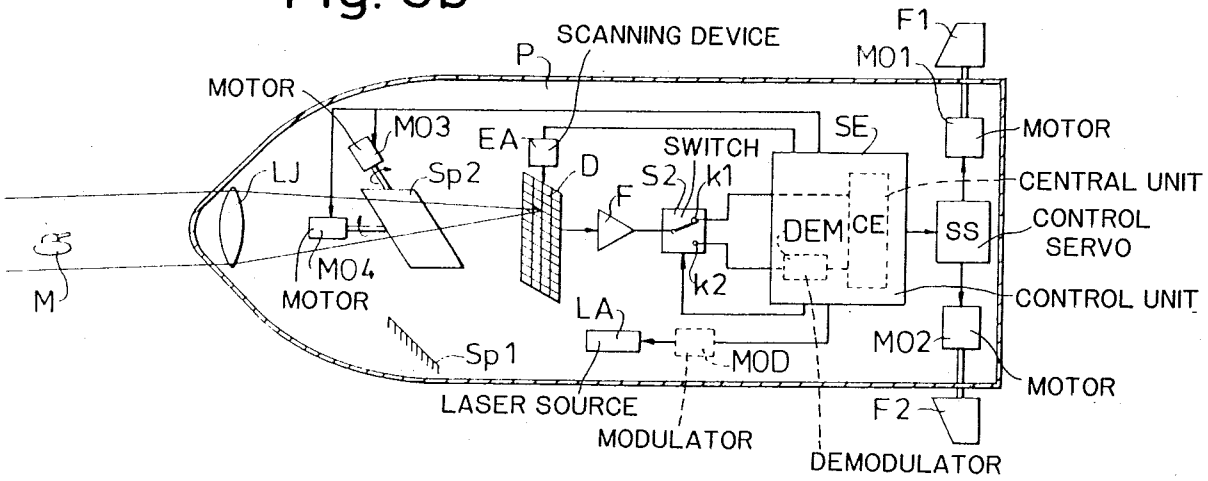
Figure 3C:
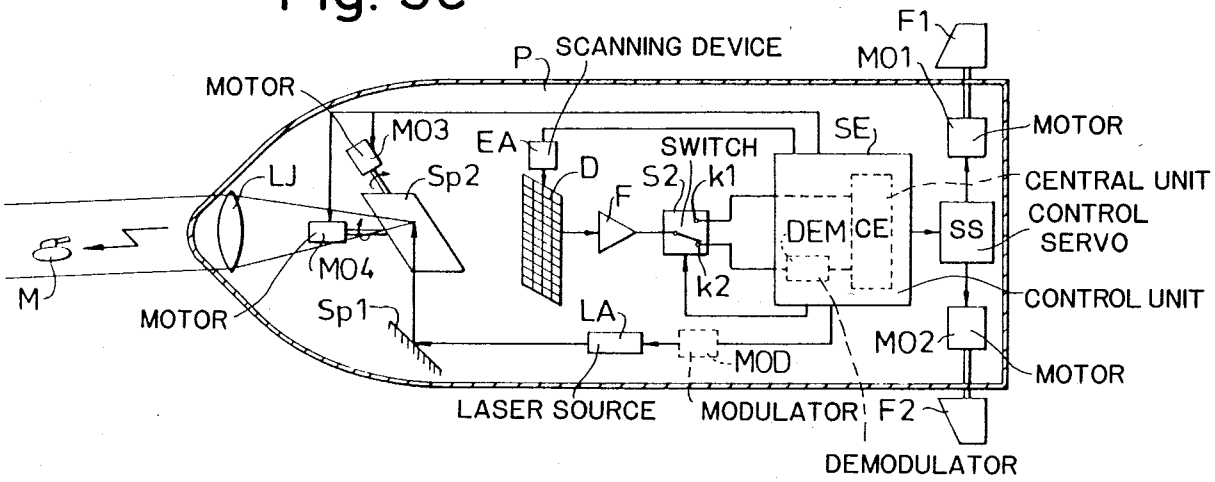

FIGS. 3*a*–3*c* show a projectile comprising an electro-optic target tracking device using laser light. The projectile has in its nose an optic lens LJ which projects an image of the target area lying in front of it onto a detector mosaic sheet D which is scanned by means of an electronically controlled scanning device, for example a CCD (charged coupled device) EA which in turn is controlled by SE. The signal from the detector D is applied via an amplifier F and the switch S2, which has the same function as S2 in the foregoing embodiments, to a signal processing unit SE. For illuminating a target there is a laser source LA cooperating with a fixed mirror SP1 and an adjustable mirror SP2 for transmitting the light via the lens LJ to the target area. The setting of the mirror SP2 is controlled by two motors MO3 and MO4. The mirror is shown in an exaggerated scale for the sake of clearness. Initiation of the laser source LA as well as setting of the mirror SP2 via the motors MO3 and MO4 and also the electronic scanning of the detector D and the setting of the switch S2 is controlled by the unit SE. If desired, a modulator MOD can be included in the control line to the laser source LA for modulating the transmitted laser light.

In FIG. 3*a* the projectile is situated at a large distance from a target M which is illuminated with laser light from the foregoing projectile. The adjustable mirror SP2 is set in line with the incoming radiation so that it does not hide the detector D. The radiation from the area lying in front of the projectile comprising the illuminated target area is projected by the lens LJ onto the detector, which is continuously scanned so that a video signal is obtained from the detector. In this signal the illuminated area produces a significant peak, the time position of which in the video signal indicates the target position. This signal comprising information about the target position is amplified by the amplifier F and passes via the switch S2 to the input for semi-active mode on the control unit SE. In case that the illumination produced by the foregoing projectile is modulated there is a demodulator DEM connected to this input, which will result in a more accurate separation of the illuminated target area relative to the background. The unit SE produces in known manner from the video signal an error signal which is fed to the guidance servo system for adjusting the guidance fins via the motors MO1 and MO2 such that the error signal is reduced toward zero. When the illuminating projectile immediately thereafter hits the ground and the illumination disappears the setting of the fins is maintained, either by memory means in the unit SE or in the guidance servo system, so that the projectile continues in its corrected trajectory.

In FIG. 3*b* the illumination of the target area from the foregoing projectile has disappeared. The mirror SP2 is still set in such a position that it does not hide the detector, while the switch S2 has been switched to the other position k1, i.e. the position for passive scanning. The lens projects the image of the area lying in front of the projectile onto the detector sheet D which is continuously scanned. At the beginning of this phase the target often can not be distinguished from the background and the projectile continues in its corrected trajectory. At the end of the phase the target's own radiation is so strong that the target is detected, which for example occurs when the video signal exceeds a threshold value. This phase, with detection of the target's own radiation, often requires a somewhat different signal processing than in the foregoing case with detection of a known radiation, which in the drawing as in the foregoing examples has been indicated by two signal inputs and signal paths in SE. The purpose of the signal processing is, as in the foregoing examples, to determine the position of the target relative to the projectile trajectory from the video signal and from this to derive an error signal, which is used to adjust the guiding fins and guide the projectile towards the target.

During the last part of the trajectory towards the target switching to illumination mode, which is shown in FIG. 3*c*, takes place. By means of the motors MO3 and MO4 and with the aid of the latest information about the position of the target relative to the projectile trajectory, the mirror SP2 is adjusted to such a position that a radiation beam from the laser source LA via the mirrors SP1 and SP2 is directed towards the target. Thereafter the laser source LA is activated, via a modulator MOD, so that the target is illuminated. The illumination can if desired be effected intermittently and alternate with a passive operation mode according to the foregoing phase. Switching to the illumination mode can be timed, for example as counted from the moment when the video signal exceeds the threshold value, or by means of calculated information about the distance which can be available in the central unit, or if desired by means of information from a separate distance measuring device. During the last part of the trajectory the target is illuminated as an aid for a following projectile.

The invention is not limited to any special type of target tracking device or any special type of radiation, but all known types of tracking devices and wave length ranges can be used, for example tracking devices operating with infrared radiation. The invention can be used in projectiles which have no driving means or with those provided with driving means (so called missiles).

What is claimed is:

1. A weapon system for guiding projectiles to a target at which they are fired, said projectiles including:

(a) at least one target illuminating projectile having illuminating means for directively transmitting illuminating electromagnetic radiation towards the target only during a latter part of a continuing path of travel of said illuminating projectile toward said target; and (b) at least one self-guided projectile having a target tracking device comprising:

(1) receiving and detecting means adapted for receiving and detecting illuminating electromagnetic radiation transmitted by a target illuminating projectile and reflected from the target;

(2) signal processing means coupled to the receiving and detecting means for producing an error signal representing deviation of the self-guided projectile's path of travel from the target; and (3) guiding means coupled to the signal processing means and responsive to said error signal to adjust the path of travel of the self-guided projectile to reduce said deviation;

said illuminating means comprising a multilobe antenna and means coupled to said antenna and to said signal processing means for selectively activating a lobe of said antenna in which the target is detected.

2. A weapon system for guiding projectiles to a target at which they are fired, said projectiles including:

(a) at least one target illuminating projectile having illuminating means for directively transmitting illuminating electromagnetic radiation towards the target only during a latter part of a continuing path of travel of said illuminating projectile toward said target; and (b) at least one self-guided projectile having a target tracking device comprising:

(1) receiving and detecting means adapted for receiving and detecting illuminating electromagnetic radiation transmitted by a target illuminating projectile and reflected from the target;

(2) signal processing means coupled to the receiving and detecting means for producing an error signal representing deviation of the self-guided projectile's path of travel from the target; and (3) guiding means coupled to the signal processing means and responsive to said error signal to adjust the path of travel of the self-guided projectile to reduce said deviation;

said illuminating means comprising a laser light source and means coupled to said source and to said signal processing means for directing a light beam from said source toward the target.

* * * * *